US006041626A

United States Patent [19]

Jung

[11] Patent Number: 6,041,626

[45] Date of Patent: Mar. 28, 2000

[54] DUAL STRUCTURE WASHING TUB FOR USE IN A WASHING MACHINE

[75] Inventor: Young Jun Jung, Seoul, Rep. of Korea

[73] Assignee: Daewoo Electronics Co., Ltd., Rep. of Korea

[21] Appl. No.: 09/213,151

[22] Filed: Dec. 17, 1998

[30] Foreign Application Priority Data

Jun. 30, 1998 [KR] Rep. of Korea ..... 98-11589

[51] Int. Cl.[7] ..... D06F 17/06

[52] U.S. Cl. ..... 68/23.2; 68/53

[58] Field of Search ..... 68/18 F, 23.2, 68/53

[56] References Cited

U.S. PATENT DOCUMENTS 5,509,283 4/1996 Lee et al. ..... 68/53 X

FOREIGN PATENT DOCUMENTS 142892 7/1985 Japan ..... 68/53

*Primary Examiner*—Philip R. Coe

*Attorney, Agent, or Firm*—Pennie & Edmonds LLP

[57] ABSTRACT

A washing tub for use in a washing machine has a reservoir water tub in a cabinet, a pulsator rotatably disposed at bottom thereof and a balancer mounted on top thereof. The washing tub includes an outer tube having a base and a body mounted on the base, an inner tube disposed within the outer tube at regular intervals and guide members interposed between the outer and the inner tubes. The inner tube has a basal part opposed to the base of the outer tube and a body mounted on the basal part. The body of the outer tube consists of a plurality of first panels with a plurality of through-holes and a plurality of second panels alternatively connected to each other, while the body of the inner tube consists of a plurality of first plates with a plurality of through-holes opposed to each of the first panels of the outer tube and a plurality of second plates opposed to each of the second panels alternatively connected to each other. Each of the guide members has an outer wall contacted with each of the second panels of the outer tube, an inner wall opposed to the outer wall and contacted with the second plate of the inner tube, and two side walls for enclosing both sides of the outer and the inner walls to form a waterway therein.

6 Claims, 6 Drawing Sheets

DUAL STRUCTURE WASHING TUB FOR USE IN A WASHING MACHINE

FIELD OF THE INVENTION

The present invention relates to a washing tub for use in a washing machine; and, more particularly, to a washing tub employing a dual structure therein capable of smoothly circulating laundering water and preventing the washing tub from getting deformed and damaged.

DESCRIPTION OF THE PRIOR ART

As is well known, a washing machine is designed to automatically perform various different modes of washing, e.g., washing mode, rinsing mode, dehydrating mode, to clean laundries.

There is shown in FIGS. 1A and 1B a washing machine having a supplying water valve 12 at a rear and an upper portions of a cabinet 10 and a reservoir water tub 20 in the cabinet 10. A shower ring 22 into which water is supplied from the supplying water valve 12 is mounted on an upper portion of the reservoir water tub 20. A washing tub 30 disposed to the reservoir water tub 20 consists of a cylindrical washing tub base 32 and a cylindrical washing tub body 34 assembled with an upper portion of the washing tub base 32. A pair of inlet ports 32*a* are formed on both sides of an inner periphery of the washing tub base 32, respectively. The washing tub body 34 includes a plurality of panels 34*a*, each of the panels being provided with a plurality of holes 34*b*, each of which is communicated into the reservoir water tub 20. Mounted on an upper portion of the washing tub body 34 is a balancer 36 which is provided with a pair of outlet ports 36*a* facing each other at bottom of an inner periphery thereof.

Mounted on both sides of the inner periphery of the washing tub body 34, respectively, are a pair of guide filters 40 facing each other. Formed between each of the guide filters 40 and the washing tub body 34 is a waterway 40*a* which communicates between the inlet port 32*a* of the washing tub base 32 and the outlet port 36*a* of the balancer 36. A filter unit 42 is mounted on top of each of the waterways 40*a*. A pulsator 60 is mounted at the center of the washing tub base 32 and is rotated through a gear mechanism 52 to which a driving force of a motor 50 is applied. A plurality of exhausting ports 62 are formed on a periphery of the pulsator 60 on which a plurality of blades 64 are radially formed at bottom thereof. A foam generator 70 is mounted at bottom of the reservoir water tub 20 to thereby generate foam.

When the user selects a desired washing operation, the pulsator 60 is rotated by the gear mechanism 52 into which the driving force of the motor 50 is applied in such a way that a cyclone water flow is generated. Further, an exhausting water flow is generated when the cyclone water flow is gushed out through the exhausting ports 62. Foams generated by the foam generator 70, e.g., air bubbles, are added to the exhausting water flow, performing the washing mode of the washing machine. At this time, laundering water within the washing tub 30 is introduced through the inlet ports 32*a* of the washing tub base 32 by the rotation of the pulsator 60 and then is supplied into the outlet ports 36*a* of the balancer 36 through the waterways 40*a* of the guide filters 40. As a result, the laundering water supplied into the outlet port 36*a* of the balancer 36 falls down from top to bottom of the washing tub 30, generating a so-called waterfall flow.

However, according to the structure of the conventional washing tub, the guide filters 40 must be mounted on both sides of the inner periphery of the washing tub body 34 by means of a screw, which, in turn, decreases an assembling efficiency thereof. Furthermore, the guide filters 40 must not only be precisely assembled in the inlet port 32*a* of the washing tub base 32 and the outlet port 36*a* of the balancer 36, but also must be tightly assembled so that there is no gap between the washing tub body 34 and each of the guide filters 40. Accordingly, substantial efforts are required to assemble the guide filters 40, for the presence of the gap therebetween might cause the laundries to get caught at the gap and damaged thereat.

SUMMARY OF THE INVENTION

It is, therefore, a primary object of the present invention to provide a dual structure washing tub capable of preventing laundries from getting damaged at an inner surface thereof.

The another object of the present invention is to provide a dual structure washing tub which is designed to increase a circulating flow of the laundering water as well as its strength.

The above and other objects of the invention are accomplished by providing a washing tub for use in a washing machine having a reservoir water tub in a cabinet, a pulsator rotatably disposed at bottom thereof and a balancer mounted on top thereof, the washing tub including:

an outer tube having a base with an opening, through which a driving shaft of the pulsator is rotatably disposed, and a body mounted on the base, the body consisting of a plurality of first panels with a plurality of through-holes and a plurality of second panels alternatively connected to each other;

an inner tube disposed within the outer tube at regular intervals and having a basal part opposed to the base of the outer tube and having an opening corresponding to the opening of the outer tube and a body mounted on the basal part, the body consisting of a plurality of first plates with a plurality of through-holes opposed to each of the first panels of the outer tube and a plurality of second plates opposed to each of the second panels alternatively connected to each other; and guide members interposed between the outer and the inner tubes, each of the guide members having an outer wall contacted with each of the second panels of the outer tube, an inner wall opposed to the outer wall and contacted with each of the second plates of the inner tube, and two side walls for enclosing both sides of the outer and the inner walls to form a waterway therein.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1A:
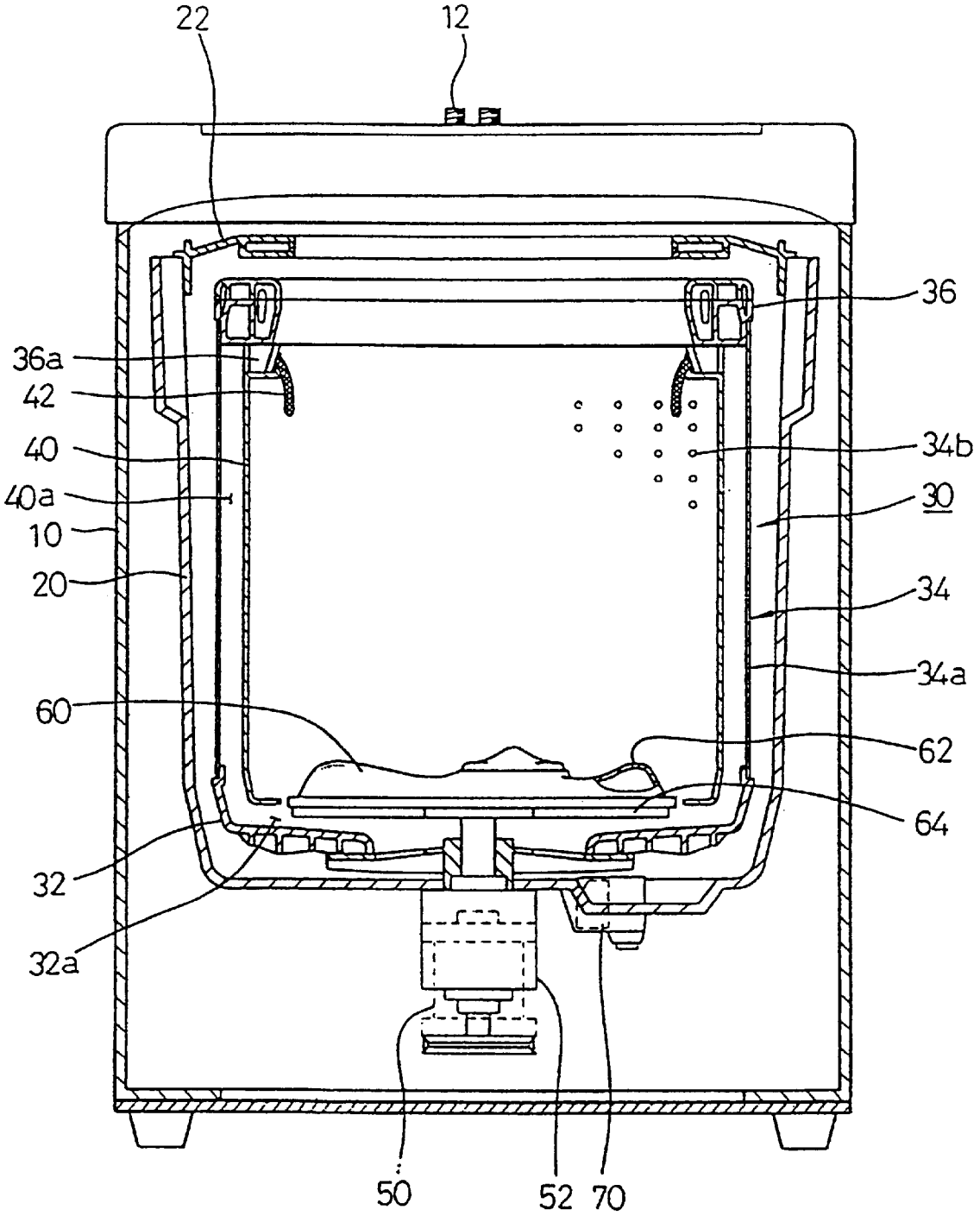
FIG. 1A (PRIOR ART)
FIGS. 1A and 1B show a sectional view of a conventional washing machine and an exploded perspective view of an embodiment of a washing tub, respectively.
Figure 1B:
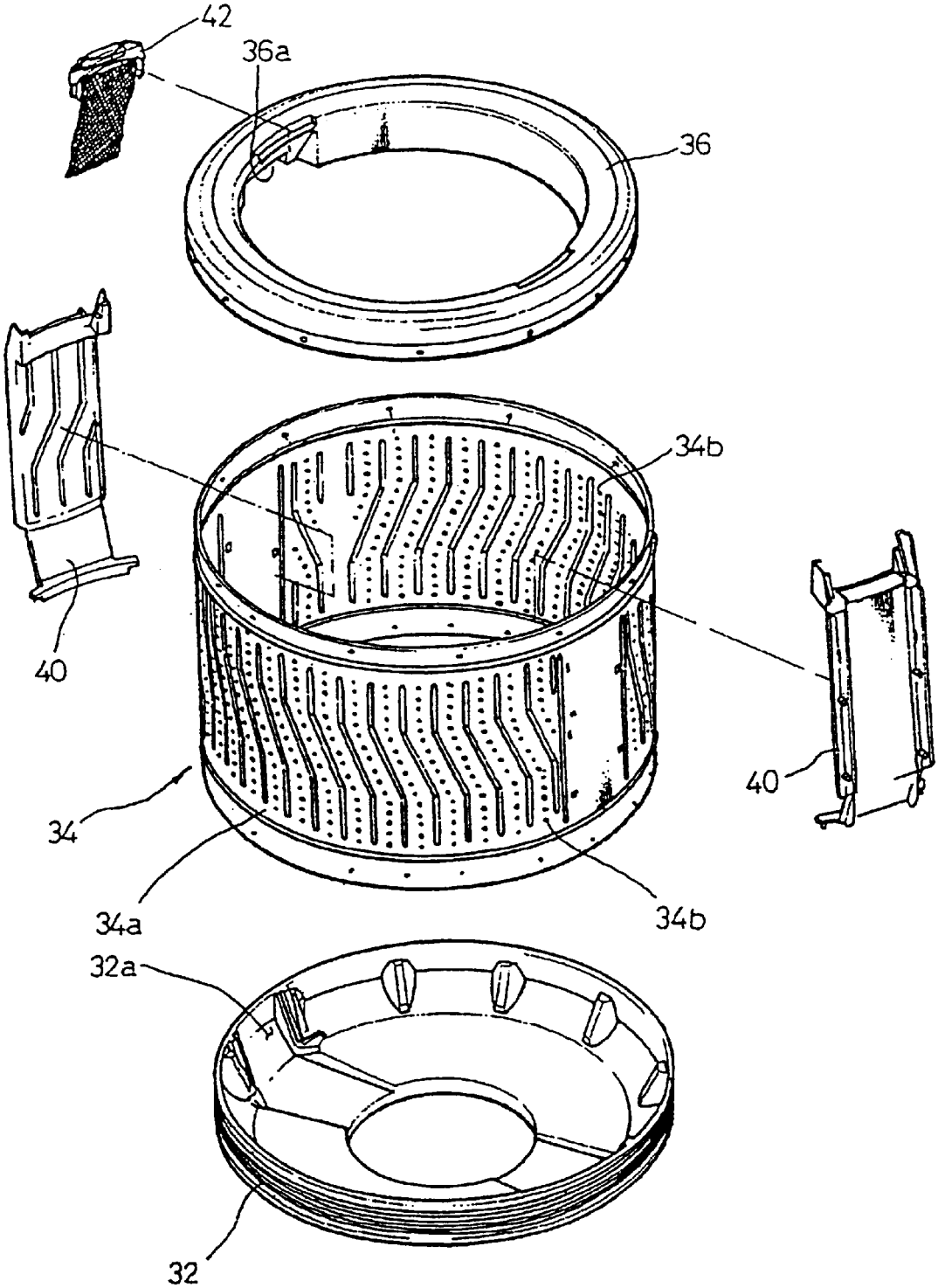
FIG. 1B (PRIOR ART)
Figure 2:
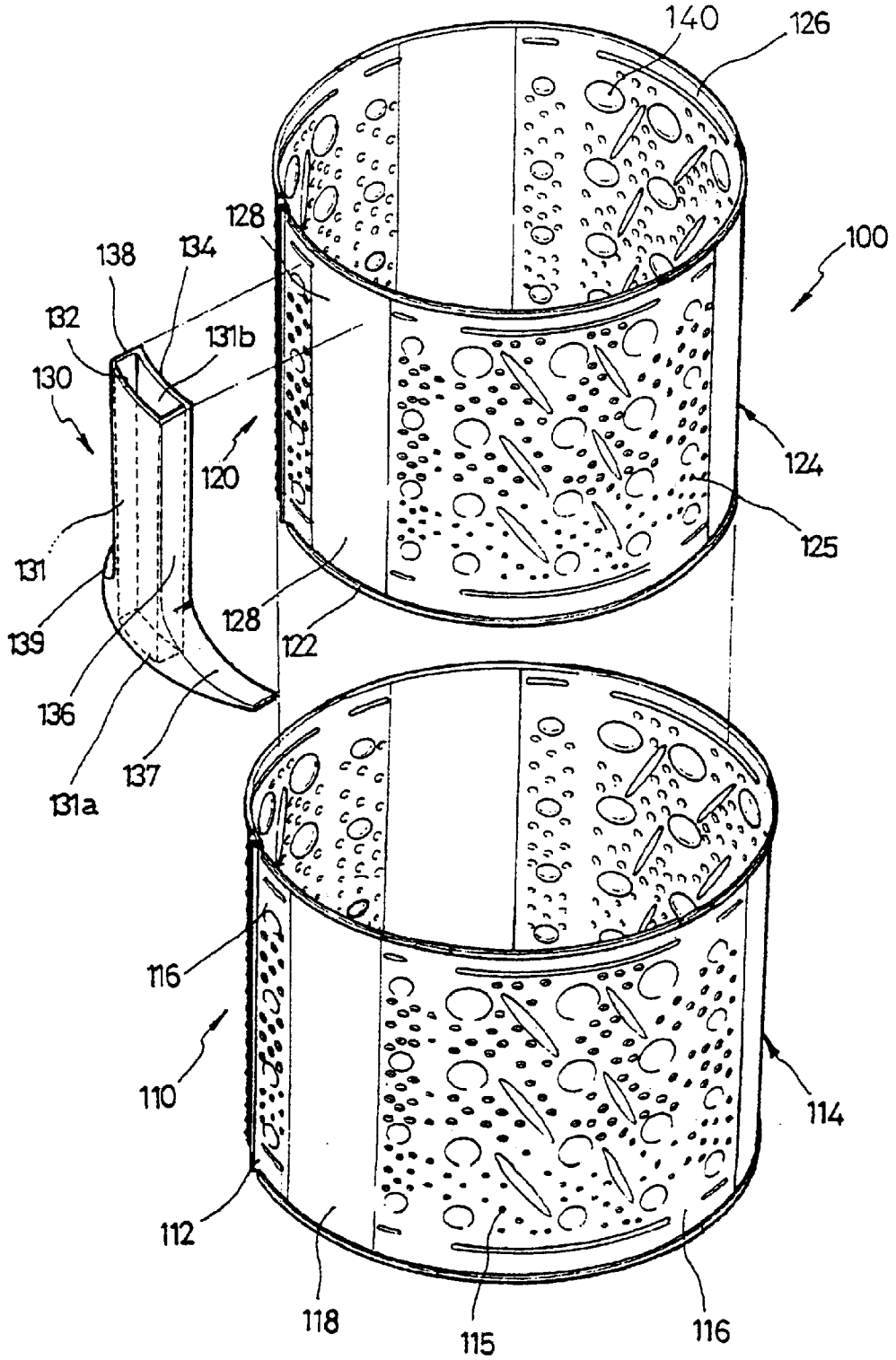
FIG. 2 illustrates an exploded perspective view of a washing tub in accordance with a preferred embodiment of the present invention.

Referring to FIGS. 2 to 5, there is shown a washing tub for use in a washing machine in accordance with a preferred embodiment of the present invention. As shown, the inventive washing tub includes a cylindrical outer tube 110 and a cylindrical inner tube 120 for defining a laundering space and guide members 130 for drawing up laundering water within a reservoir water tub 20 from bottom of the washing tub thereto and falling down through outlet ports 36*a* of a balancer 36 into an interior of the washing tub.

To be more particular, the outer tube 110 has a base 112 with an opening, through which a driving shaft of a pulsator 60 is rotatably disposed, and a body 114 mounted on the base 112. The body 114 consists of a plurality of first panels 116 with a plurality of through-holes 115 and a plurality of second panels 118 alternatively connected to each other to thereby form a circle. It is preferable that the first and the second panels may be integrally formed to one another.

Figure 3:
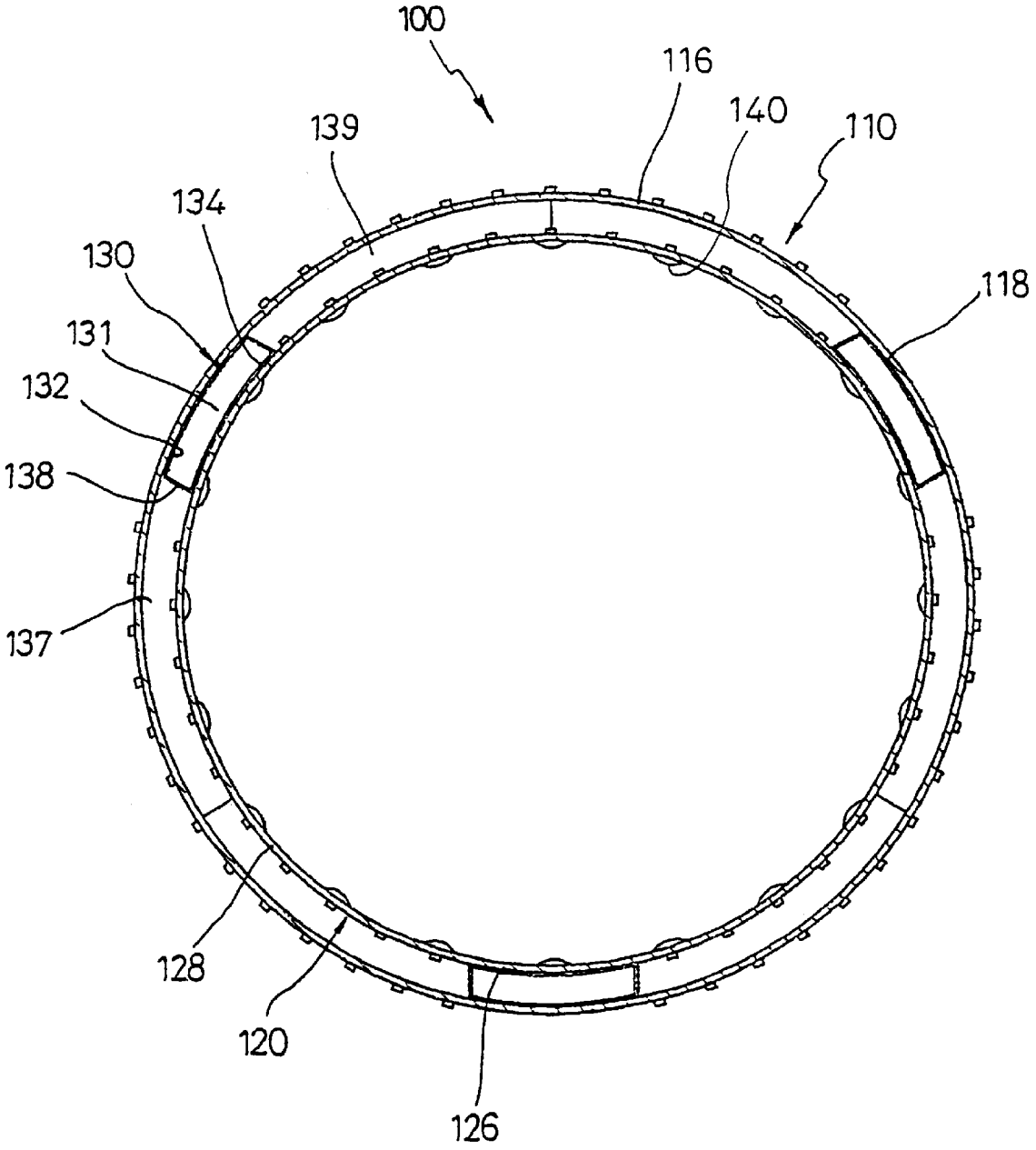
FIG. 3 depicts a cross sectional view for showing the washing tub of FIG. 2.

On the other hand, the inner tube 120 is disposed within the outer tube 110 at regular intervals as a diameter thereof is smaller than that of the outer tube 110. The inner tube 120 has a basal part 122 with an opening corresponding to the opening of the outer tube 110 and opposed to the base 112 of the outer tube 110 and a body 124 mounted on the basal part 122. The body 124 consists of a plurality of first plates 126 with a plurality of through-holes 125 opposed to each of the first panels 116 of the outer tube 110 and a plurality of second plates 128 opposed to each of the second panels 118 alternatively connected to each other to thereby form a circle. It is preferable that the first and the second plates 126 and 128 may be integrally formed to one another. Further, it is preferable that the first and the second plates 126 and 128 may be provided with projections 140 in inner surfaces thereof as shown in FIG. 3 in order to improve a laundering efficiency.

Interposed between the outer and the inner tubes 110 and 120 are the guide members 130 which serve as means for drawing up the laundering water from bottom to top. Each of the guide members 130 has an outer wall 132 contacted with each of the second panels 118 of the outer tube 110, an inner wall 134 opposed to the outer wall 132 and contacted with each of the second plate 128 of the inner tube 120, and two side walls 136 and 138 for enclosing both sides of each of the outer and the inner walls 132 and 134 to form a waterway 131 therein. In other word, each of the guide members 130 is provided with an inlet port 131*a* communicated to the waterway 131 at bottom thereof to introduce the laundering water between the base 112 of the outer tube 110 and the basal part 122 of the inner tube 120, and an outlet port 131*b* communicated to the waterway 131 at top thereof to supply the laundering water in the waterway 131 into the outlet ports 36*a* of the balancer 36.

Furthermore, a pair of flanges 137 and 139 are circumferentially extended from bottom of each of the side walls 136 and 138 in such a way that a tip end of one flange is connected to a tip end of other flange of a neighboring guide member 130 to thereby enclose a lower portion of a space between the outer and the inner tubes 110 and 120 except for a space occupied by the waterways 131 to prevent the laundering water from entering at the waterways 131. In particular, it is preferable that each of the side walls 136 and 138 being in contact with each of the flanges 137 and 139, e.g., a lower portion of the side walls 136 and 138, may be in the form of rounded-shape to thereby easily allow the laundering water to go in and out through the inlet ports 131*a*.

The guide members are mounted between the outer and the inner tubes 110 and 120 by welding or an adhesive. For instance, if the outer and the inner tubes and the guide members are made of a metal, it is preferable that the guide members may be mounted therebetween by welding, whereas if these components are made of a synthetic resin such as plastic, it is preferable that the guide members may be mounted therebetween by an adhesive.

Figure 4:
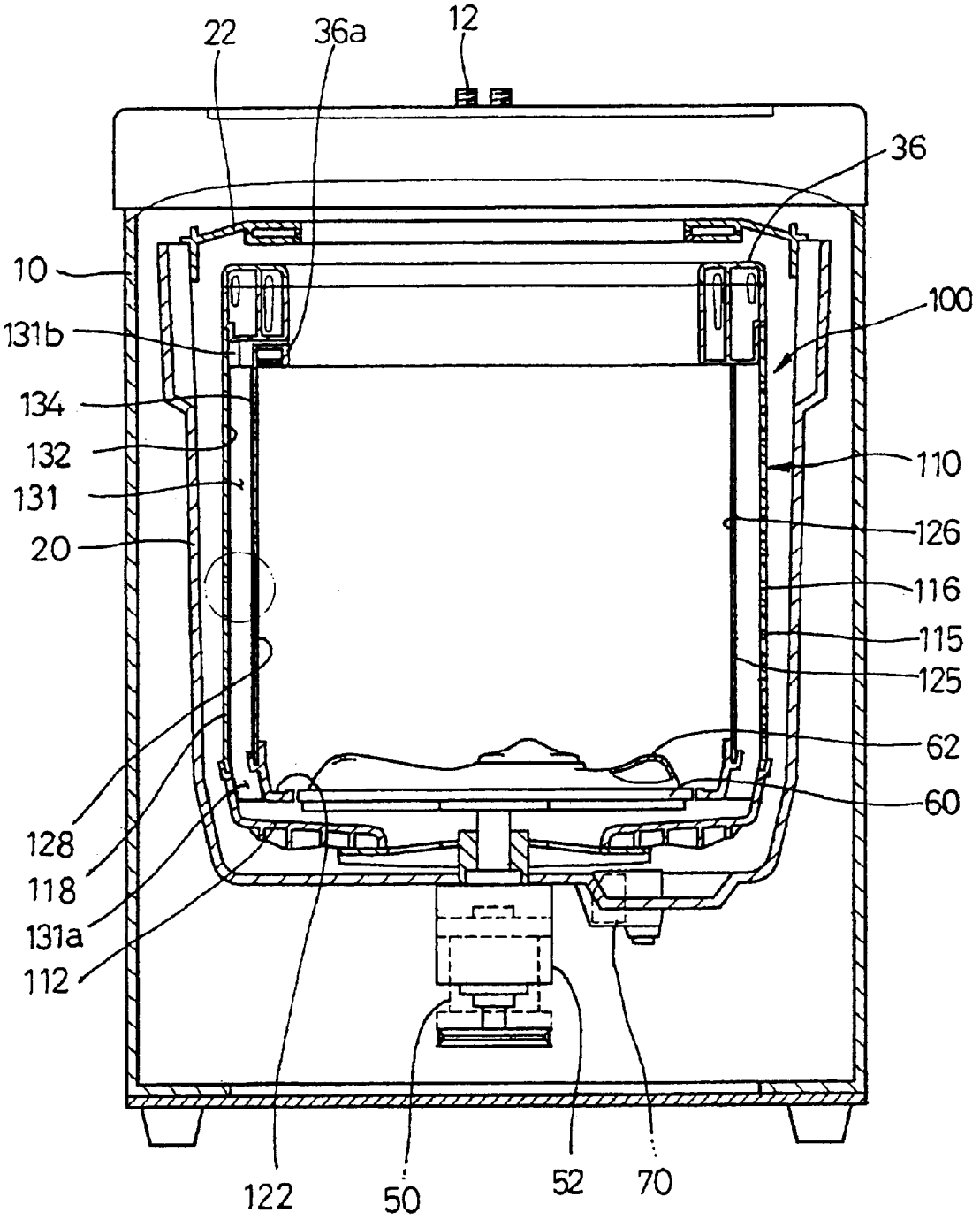
FIG. 4 sets forth a vertical sectional view for showing the inventive washing tub disposed to a cabinet of a washing machine.
Figure 5:
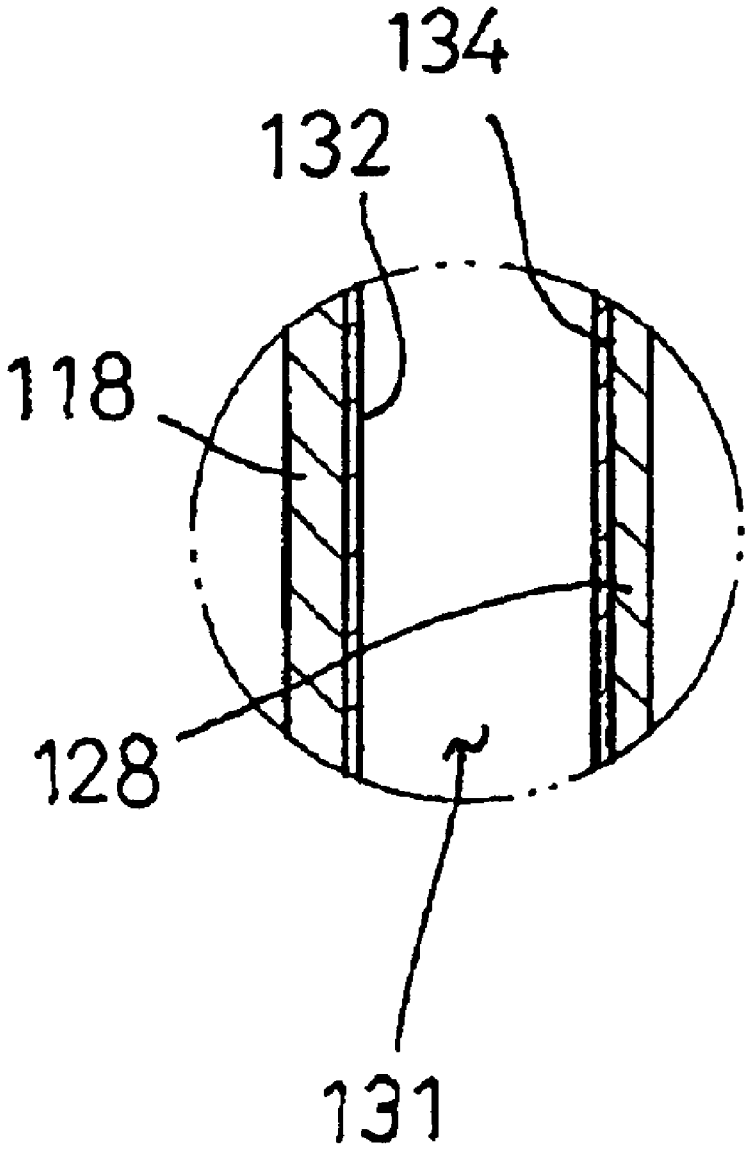
FIG. 5 offers a detailed view of the portion within the circle in FIG. 4.

The operation of the washing tub in accordance with the present invention will be described in connection with FIG. 4 as follows:

When the user selects a desired washing operation, water from the water supplying valve 12 is supplied to the shower ring 22 and then fall down toward an interior of the washing tub 100 from an inner periphery of the shower ring 22 to thereby generate a so-called shower flow, resulting in the water being restored through the holes 125 of the inner tube 120 and the holes 115 of the outer tube 110 in the reservoir water tub 20.

Thereafter, the pulsator 60 is rotated through the gear mechanism 52 into which the driving force of the motor 50 is applied in such a way that a cyclone water flow is generated. Further, an exhausting water flow is generated when the cyclone wter flow is gushed out through the exhausting ports 62. Foams generated by the foam generator 70, e.g., air bubbles, are added to the exhausting water flow, performing the washing operation of the washing machine.

Further, according to the rotation of the pulsator 60, the laundering water between the base 112 of the outer tube 110 and the basal part 122 of the inner tube 120 is supplied through the waterway 131 from the inlet port 131*a* of the guide members 130 to the outlet 131*b* thereof to thereby supply the laundering water into the outlet port 36*a* of the balancer 36. As a result, the laundering water supplied into the outlet port 36*a* of the balancer 36 falls down from top to bottom of the washing tub 30, generating a so-called waterfall flow. The waterfall flow impacts against the laundries positioned at a periphery of the washing tub 100 to thereby wash the laundries. At this time, as both sides of the inlet port 131*a* and a connecting portion of each of the flanges 137 and 139 are of rounded-shape, the laundering water easily enters through the inlet port 131*a* to the waterway 131.

While the present invention has been described with respect to the preferred embodiment, it will be understood by those skilled in the art that certain changes and modifications may be made without departing from the scope of the invention as defined in the following claims.

What is claimed is:

1. A washing tub for use in a washing machine having a reservoir water tub in a cabinet, a pulsator rotatably disposed at bottom thereof and a balancer mounted on top thereof, the washing tub including:

an outer tube having a base with an opening, through which a driving shaft of the pulsator is rotatably disposed, and a body mounted on the base, the body consisting of a plurality of first panels with a plurality of through-holes and a plurality of second panels alternatively connected to each other;

an inner tube disposed within the outer tube at regular intervals and having a basal part opposed to the base of the outer tube and having an opening corresponding to the opening of the outer tube and a body mounted on the basal part, the body consisting of a plurality of first plates with a plurality of through-holes opposed to each of the first panels of the outer tube and a plurality of second plates opposed to each of the second panels alternatively connected to each other; and guide members interposed between the outer and the inner tubes, each of the guide members having an outer wall contacted with each of the second panels of the outer tube, an inner wall opposed to the outer wall and contacted with each of the second plates of the inner tube, and two side walls for enclosing both sides of the outer and the inner walls to form a waterway therein.

2. The washing tub as recited in claim 1, wherein each of the guide members is provided with an inlet port communicated to the waterway at bottom thereof to introduce laundering water between the base of the outer tube and the basal part of the inner tube, and an outlet port communicated to the waterway at top thereof to supply the laundering water in the waterway into outlet ports of the balancer.

3. The washing tub as recited in claim 2, wherein the side walls of each of the guide member are integrally formed with a pair of flanges at bottom thereof, a tip end of one flange being connected to a tip end of other flange of a neighboring guide member.

4. The washing tub as recited in claim 3, wherein each of the side walls being in contact with each of the flanges is in the form of rounded-shape.

5. The washing tub as recited in claim 1, wherein the side walls of each of the guide member are integrally formed with a pair of flanges at bottom thereof, a tip end of one flange being connected to a tip end of other flange of a neighboring guide member.

6. The washing tub as recited in claim 3, wherein each of the side walls being in contact with each of the flanges is in the form of rounded-shape.

* * * * *